United States Patent [19]

Gaudin

[11] Patent Number: 4,872,861

[45] Date of Patent: Oct. 10, 1989

[54] GLIDE BOARD WITH RUDDER

[75] Inventor: Serge Gaudin, 15 Avenue de la République, F-40600 Biscarosse, France

[73] Assignees: Serge Gaudin, Biscarosse; Henry Clauzet, Paris; Jean-Pierre Daures, Mont de Marsan, all of France

[21] Appl. No.: 203,816

[22] Filed: Jun. 8, 1988

[30] Foreign Application Priority Data

Jun. 10, 1987 [FR] France ..... 87 08162

[51] Int. Cl.[4] ..... B63H 25/16

[52] U.S. Cl. ..... 441/79; 441/74; 114/162

[58] Field of Search ..... 114/270, 343, 162, 163; 440/38; 441/65, 74, 79

[56] References Cited

U.S. PATENT DOCUMENTS

| | | | |
|---|---|---|---|
| 4,619,619 | 10/1986 | Muse, Jr. | 441/74 |
| 4,708,675 | 11/1987 | Shoeffler et al. | 441/79 |

FOREIGN PATENT DOCUMENTS

| | | | |
|---|---|---|---|
| 31663 | 2/1973 | Australia . | |
| 3150228 | 6/1983 | Fed. Rep. of Germany | 441/65 |
| 2468391 | 5/1981 | France . | |
| 62-71791 | 4/1987 | Japan | 114/343 |

*Primary Examiner*—Joseph F. Peters, Jr.
*Assistant Examiner*—Edwin L. Swinehart
*Attorney, Agent, or Firm*—Foley & Lardner, Schwartz, Jeffery, Schwaab, Mack, Blumenthal & Evans

[57] ABSTRACT

Board with rudder comprising on its lower face at least one rudder mounted for swivelling in the body of the board and actuatable by a means accessible on the upper face of the board, disposed substantially in the central zone of the board and formed of two manual members separated by a profiled portion formed so as to allow the user to lie on the board with his chest along said profiled portion, said board being provided in its rear half-portion, on its upper face, with two parallel elongate housings formed in the mass of the board for receiving the leg portions of the user below his knees, when kneeling on the board.

7 Claims, 5 Drawing Sheets

GLIDE BOARD WITH RUDDER

The present invention relates to a glide board with rudder.

The purpose of the invention is to provide a glide board for use on the ocean or a fast-moving river which is more stable and easier to handle than the gliding boards known at present such as surf boards in particular.

To this end, the invention has as object a glide board with rudder, comprising on its lower face at least one rudder journalled in the body of the board and operable by a means accessible on the upper face of the board, disposed substantially in the central zone of the board and formed of two manual members separated by a profiled portion shaped so as to allow the user to lie on the board with his chest along said profiled portion, said board being provided in its rear semi-portion, on its upper face, with two parallel elongate housings formed in the mass of the board for receiving the portions of the legs of the user below the knees when kneeling on the board.

The board of the invention is in particular more stable than the traditional glide boards because of the kneeling position of the user and much more easy to handle because of the rudder which can be turned very easily at will and because of the possibility of lying flat on the board and rowing, which makes it possible for a very wide public to be rapidly and easily initiated in the joys of the glide board while providing pleasures and sensations not obtainable with conventional boards.

Other features and advantages will be clear from the following description of a few embodiments of the device of the invention, which description is given solely by way of example with reference to the accompanying drawings in which.

Figure 1:
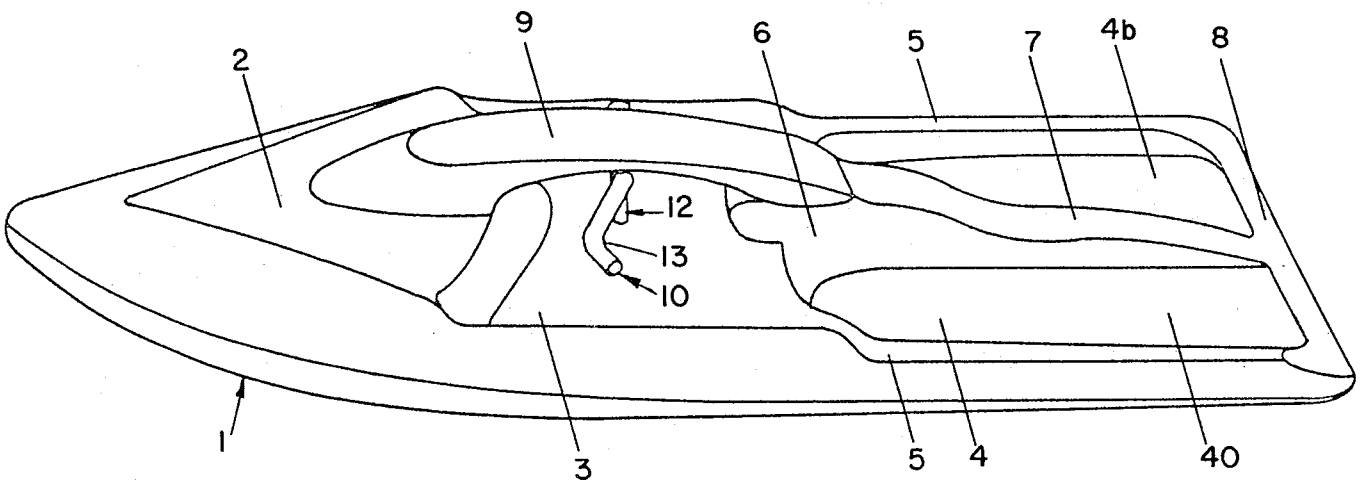
FIG. 1 is a side perspective view of a board of the invention seen from above.
Figures 2, 3:
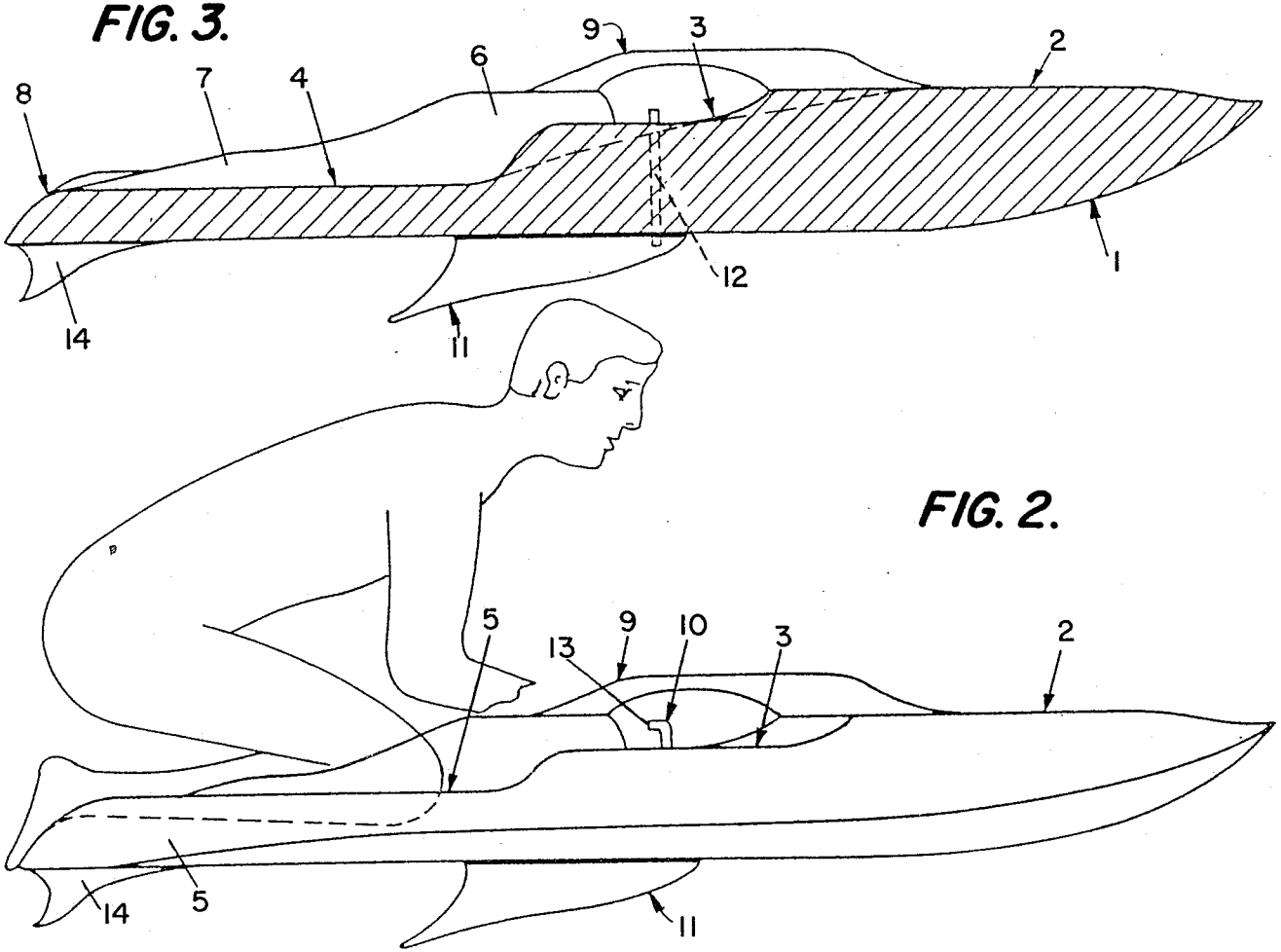
FIG. 2 is a side elevational view of the board of FIG. 1.
FIG. 3 is a schematical view in vertical section substantially through the axis of the board.
Figure 4:
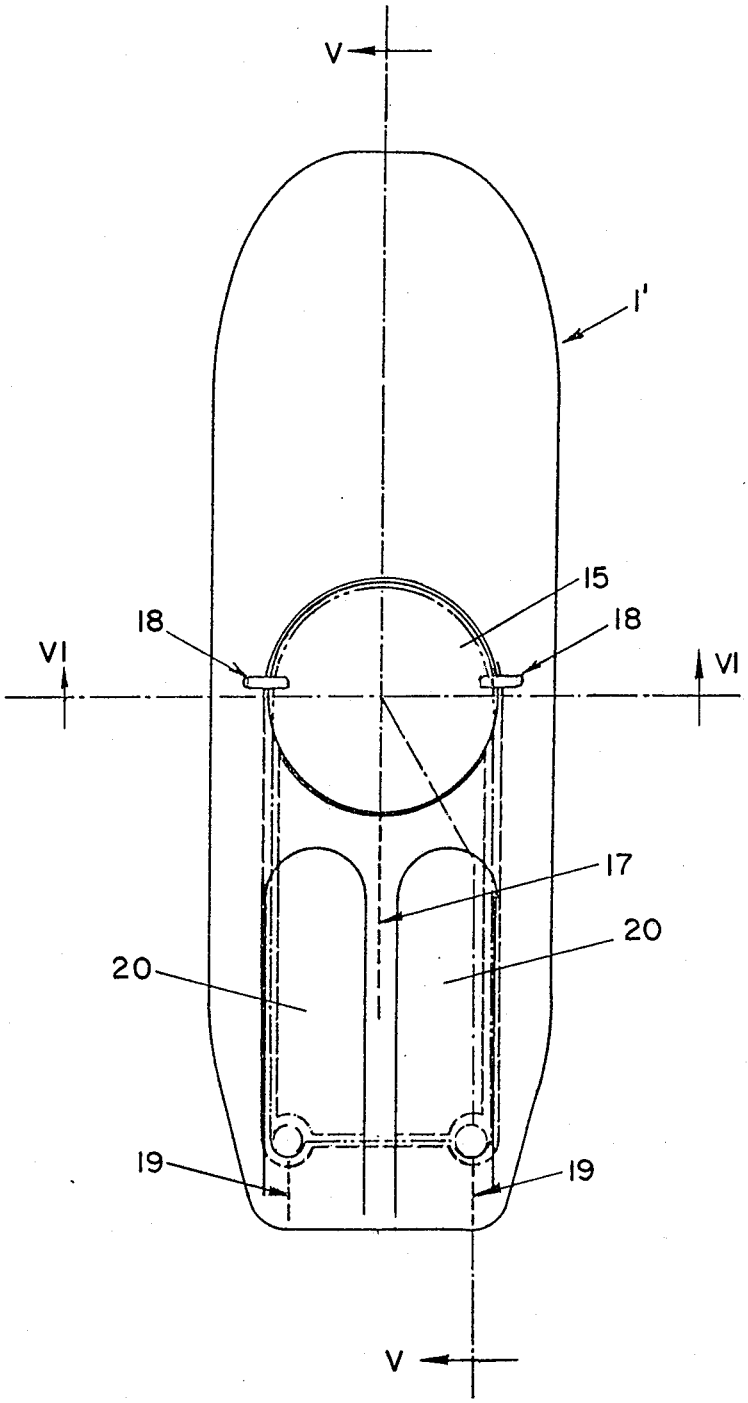
FIG. 4 is a schematical top view of a variant of the board shown in FIGS. 1, 2 and 3.
Figure 6:
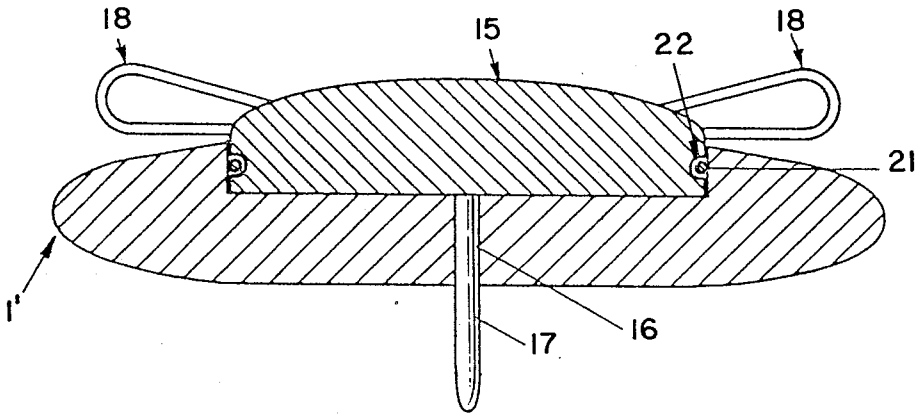
FIG. 6 is a sectional view through line VI—VI of the board of FIG. 4, and FIG. 7 illustrated the system for controlling the central rudder and two fin rudders on the board shown in FIG. 4.
Figure 5:
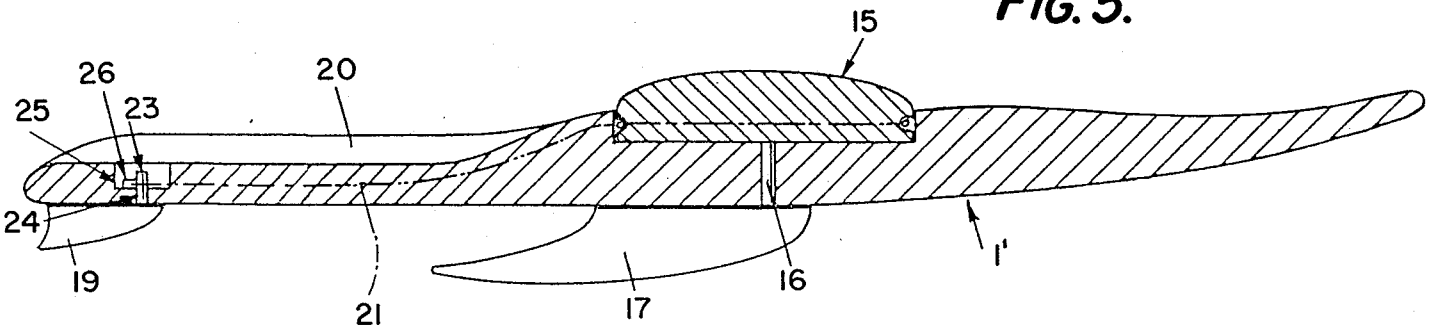
FIG. 5 is a vertical sectional view through line V—V of the board shown in FIG. 4.

The board shown schematically in FIGS. 1 to 3 is formed of a one-piece plate (1) made from an appropriate plastic material, particularly the materials including composite materials usually used for manufacturing surfing, windsurfing boards, etc.

This plate 1 is of course streamlined on its lower face and at the front for optimum penetration in and gliding over the water.

In this embodiment shown, plate 1 has on its lower face three levels or planes substantially parallel to the lower face of the plate, namely an upper plane 2 at the front portion of the board, an intermediate plane 3 in the middle zone and lower plane 4 in the rear portion of the board.

The upper plane 2 has a general triangular shape and corresponds to the nose of the board, where the thickness of plate 1 is maximum, about 25 cm for example to give an order of size.

The intermediate plane 3 is situated substantially in the middle third of the apparatus and the lower plane 4 is divided into two parallel elongate strips 4*a* and 4*b* substantially symmetrical with respect to the longitudinal axis of plate 1. The thickness of this latter, in line with the lower plane (4*a*, 4*b*), is about 8 cm for example.

The length of strips 4*a*, 4*b* is determined so as to receive the portion of the legs of the user below the knees, with the user kneeling on the board as shown in FIG. 2.

Strips 4*a*, 4*b* are surrounded over the whole of their periphery, except at the rear of the board, by raised parts thus defining housings or hollows for receiving said lower leg portion.

Thus, along the side edges of the board the intermediate plane 3 is extended by two gunwales 5 situated at an intermediate height between planes 3 and 4.

In the longitudinal axis of the apparatus, plane 2 is extended, in line with front end of portions 4*a*, 4*b*, by a separation 6 running as far as the rear end of the board while progressively decreasing in height. Thus a small separating wall 7 is formed between the leg reception housings (4*a*, 4*b*), the rear ends of this wall and of the gunwales 5 being bevelled at 8 at the same time as the rear edge of plate 1.

Part 6 is connected to the triangular plane 2 by a bridge 9 substantially in the plane of the board and below which, on the intermediate plane 3, means 10 are disposed for controlling a rudder 11 disposed under plate 1, in the median longitudinal vertical plane of the board.

The rudder 11, in the embodiment shown in FIGS. 1 to 3, is fixed to a vertical shaft 12 passing through plate 1 and mounted for swivelling. The upper end of shaft 12 projects above plane 3, substantially in the centre of the board and is secured to a handlebar 13 housed under bridge 9.

Finally, two small drop keels 14, or fins, are disposed, in a way known per se, at the rear of the board under gunwales 5.

FIG. 2 illustrates the normal position of the user on the board.

His feet are normally positioned so that the instep mates with the rear bevelled edge 8 of plate 1 in the extension of housings (4*a*, 4*b*) for the lower portion of the legs.

The user, sitting or not on his ankles, is thus perfectly settled and stable on his board.

He may readily operate handlebar 13 at will which falls naturally under his hands, because of its position.

The handlebar may freely pivot under bridge 9 about its shaft with the necessary free movement.

Bridge 9 is formed so as to allow the user to lie on the board, his chest resting on bridge 9 so as to move the board using his hands as oars in the manner of surfboards, without being hindered by the handlbar 13.

Because of the particular position of the user, the stability of the apparatus is much greater than that of surfboards where he is standing. In addition, rudder 11, readily controlled at will be means of handlebar 13, confers on the board of the invention an unequal handling ability for taking advantage of all the waves and all the fast currents not only at sea but on rivers. The board has qualities which make it accessible to a very wide public and is particularly indicated for initiating beginners to gliding sports.

FIGS. 4 to 7 are a preferred embodiment of the board of the invention.

Board 1' is finer in that its thickness is appreciably less in comparison with the board shown in FIG. 3 and its upper face is more gently curved and comprises, substantially in the central zone of the board, a protuberance 15 in the form of a disk with upper convex face. This disk 15 is mounted for rotating on the upper face of board 1' and has a shaft 16 passing through the board and secured at its end to a central rudder 17 similar to rudder 11 of FIG. 3 and disposed similarly under the board.

Disk 15 has two diametrically opposite handles 18.

Rotation of disk 15 by means of the handles 18 causes rudder 17 to rotate about shaft 16 and rotates the two smaller fin rudders 19, disposed at the rear of board 1', symmetrically with respect to its longitudinal axis, under the two hollows 20 receiving the leg portions of the user below his knees, similar to hollows 4*a*, 4*b* in FIG. 1.

Figure 7:
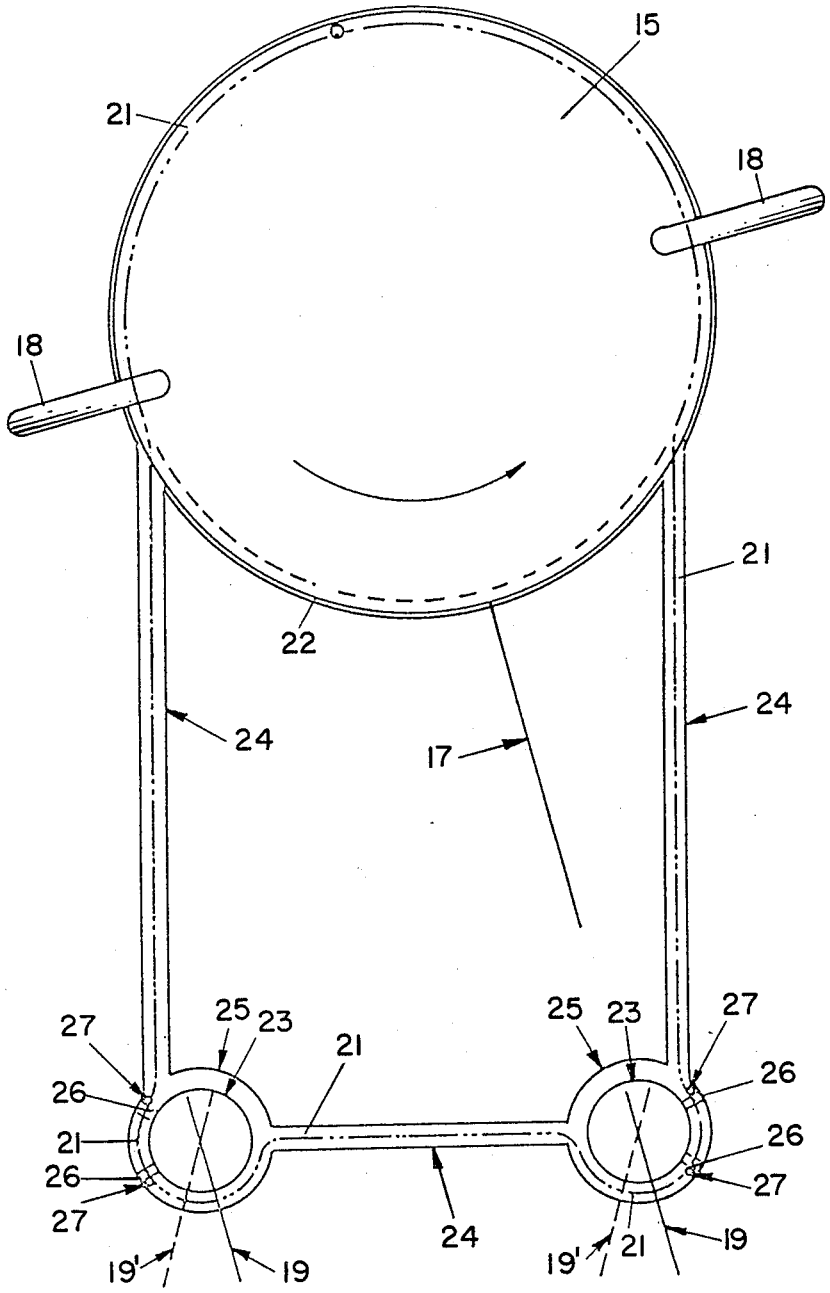

FIG. 7 illustrates the system for joint control of rudders 17 and 19.

The drive is provided by a closed loop flexible cable 21 passing through and anchored in a peripheral groove 22 of disk 15 and about shafts 23 of the fin rudders 19. Between disk 15 and shaft 23, the cable 21 slides in ducts 24 embedded in the mass of board 1'. Shafts 23 are each fixed to a fin rudder 19 and are mounted for swivelling in a sleeve 24 (FIG. 5) embedded in the mass of the board. Sleeve 24 comprises an upper part 25 of widened diameter in which a projection 26 may pivot which is secured to shaft 23 and to which cable 21 is fixed. The angular free movement of projection 26, and so of shaft 23 and of the fin rudder 19 is limited by two fixed stops 27 inside portion 25. In FIG. 7, the endmost positions of the fin rudders 19 have been shown with continuous lines 19 and broken lines 19' when disk 15 is swivelled to its two end positions, with such a system, rudders 17 and 19 remain constantly parallel.

Board 1' is handled exactly as shown in FIG. 2. Furthermore, the user may readily lie down on the board for moving it by using his hands like oars, his chest resting on the rounded protuberance of disk 15.

Of course, device 15, 18 can be adapted for driving only a single rudder 17, the fin rudder 19 being replaced by fixed fins as shown in FIG. 2.

It should be noted that the central rudder 17 could be omitted, the board being guided by the two fin-rudders 19 which could further be controlled by two separate members, each controlled by one hand, such as a small steering-wheel, handle or a lever, a cable system or similar, ensuring synchronized rotation in the same direction of the fin-rudders, being preferably provided.

It should also be noted that the handlebar 13 or disk 15 controlling rudder 11, 17 could be fixed and provided with two handles similar to brake handles and each controlling rotation in one direction of the rudder 11, 17 by means of a cable.

This same fixed handlebar-handle system could further control the two fin-rudders 19 when no central rudder 17 exists.

I claim:

1. A board with a rudder, said board comprising:

at least one rudder on a lower face of the board mounted for swivelling in the body of the board, means for actuating said rudder accessible on an upper face of the board, said means for actuating being disposed substantially in a central zone of the board and comprising two manual members covered by a profiled portion formed so as to allow a user to lie on the board with his chest along said profiled portion, two substantially parallel elongate housings provided on a rearward, upper-face portion of the board, said housings being formed in the mass of the board for receiving the leg portions of the user below his knees, when kneeling on the board.

2. The board with rudder according to claim 1, wherein said manual members are formed by a handlebar fixed to the rudder and disposed under a bridge connecting together front and rear portions of the board, said bridge being substantially coplanar with said board and defining said profiled portion.

3. The board with rudder according to claim 1, wherein said manual members are two diametrically opposite handles disposed on the periphery of a disk with a convex upper face, said disk being mounted for rotation in the central zone of the board and driving said rudder in rotation.

4. The board with rudder according to claim 1, comprising two fin-rudders disposed at the rear of the board and driven in rotation by said two manual members.

5. The board with rudder according to claim 4, wherein the two fin-rudders are rotated synchronously and in the same direction.

6. The board with rudder according to claim 5, further comprising a central rudder driven synchronously with the fin rudders and in the same direction.

7. The board with rudder according to claim 6 comprising a common system for driving the central rudder and the fin-rudders, formed by a cable passing about a disk and about shafts of the fin-rudders, said cable being anchored to the disk and the shafts, and wherein stops limit the angular free movement of the rudders.

* * * * *